US010724161B2

(12) United States Patent
Terai

(10) Patent No.: US 10,724,161 B2
(45) Date of Patent: Jul. 28, 2020

(54) METHOD OF MANUFACTURING FOOTWEAR AND FOOTWEAR

(71) Applicant: SHIMA SEIKI MFG., LTD., Wakayama (JP)

(72) Inventor: Kenta Terai, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 12 days.

(21) Appl. No.: 16/094,736

(22) PCT Filed: Feb. 21, 2017

(86) PCT No.: PCT/JP2017/006295
§ 371 (c)(1),
(2) Date: Oct. 18, 2018

(87) PCT Pub. No.: WO2017/187732
PCT Pub. Date: Nov. 2, 2017

(65) Prior Publication Data

US 2019/0116913 A1 Apr. 25, 2019

(30) Foreign Application Priority Data

Apr. 25, 2016 (JP) ..... 2016-086731

(51) Int. Cl.
*D04B 1/24* (2006.01)
*A43B 23/02* (2006.01)
(Continued)

(52) U.S. Cl.
CPC ..... *D04B 1/24* (2013.01); *A43B 1/04* (2013.01); *A43B 23/02* (2013.01); *A43B 23/0205* (2013.01); *D04B 1/22* (2013.01)

(58) Field of Classification Search
CPC ..... A43B 1/04; A43B 23/02; A43B 23/025; A43B 23/0295; A43B 23/0205; D04B 1/22; D04B 1/24
See application file for complete search history.

(56) References Cited

U.S. PATENT DOCUMENTS 4,276,671 A * 7/1981 Melton ..... A41B 11/007 12/142 T
6,862,902 B1 * 3/2005 Kim ..... A41B 11/005 66/178 R
(Continued)

FOREIGN PATENT DOCUMENTS

EP 2 149 629 A1 2/2010
EP 3 011 855 A1 4/2016
(Continued)

OTHER PUBLICATIONS

International Search Report (with translation) and Written Opinion dated Mar. 21, 2017 issued in International Application No. PCT/JP2017/006295. (9 pages).

*Primary Examiner* — Danny Worrell
(74) *Attorney, Agent, or Firm* — Rothwell, Figg, Ernst & Manbeck, P.C.

(57) ABSTRACT

A first fabric of footwear comprising a closed lower end forming a toe and an open upper end and a second fabric that is open on a side opposite the first fabric is knitted on on front and back needle beds of a flat knitting machine. Double stitches formed between stitches at the upper end of the first fabric and between stitches at the upper end of the second fabric are taken from the needle beds. Remaining stitches at the first fabric upper end are held on one needle bed, and remaining stitches at the second fabric upper end are held on the other needle bed. Fabrics that follow the remaining
(Continued)

stitches at the first fabric upper end and the remaining stitches at the second fabric upper end are knitted toward the heel of the footwear.

14 Claims, 8 Drawing Sheets

(51) Int. Cl.
*D04B 1/22* (2006.01)
*A43B 1/04* (2006.01)

(56) References Cited

U.S. PATENT DOCUMENTS

| | | | | |
|---|---|---|---|---|
| 8,448,474 | B1 * | 5/2013 | Tatler | A43B 23/0245 66/64 |
| 9,365,960 | B2 * | 6/2016 | Craig | D04B 1/26 |
| 10,316,441 | B2 * | 6/2019 | Ly | D04B 1/02 |
| 2010/0154256 | A1 * | 6/2010 | Dua | A43B 1/04 36/25 R |
| 2015/0107307 | A1 * | 4/2015 | Kosui | D04B 1/22 66/177 |
| 2015/0374062 | A1 * | 12/2015 | Ikenaka | A43B 1/04 12/142 G |
| 2016/0066651 | A1 * | 3/2016 | Terai | D04B 1/24 36/45 |
| 2017/0342612 | A1 * | 11/2017 | Kawakami | A43B 23/02 |

FOREIGN PATENT DOCUMENTS

| | | | |
|---|---|---|---|
| JP | 2012-512698 | A | 6/2012 |
| JP | 2015-014058 | A | 1/2015 |
| JP | 2015-513414 | A | 5/2015 |
| JP | 2016-220713 | A | 12/2016 |
| WO | 2008/143172 | A1 | 11/2008 |
| WO | 2014/129068 | A1 | 8/2014 |
| WO | 2014/203585 | A1 | 12/2014 |
| WO | 2016/104069 | A1 | 6/2016 |

* cited by examiner

METHOD OF MANUFACTURING FOOTWEAR AND FOOTWEAR

CROSS REFERENCE TO RELATED APPLICATION(S)

This application is a 35 U.S.C. § 371 National Stage of International Patent Application No. PCT/JP2017/006295, filed Feb. 21, 2017, designating the United States and claiming priority to Japanese patent application no. 2016-086731, filed on Apr. 25, 2016. The above identified applications are incorporated by reference.

TECHNICAL FIELD

The present invention relates to a method for manufacturing a footwear by knitting on a flat knitting machine and the manufactured footwear.

BACKGROUND ART

Patent Literature 1 (WO2014/203585) discloses knitting footwear comprising double-layered knitted fabrics of inner and outer layers. Here, two closed knitted fabrics are knitted from the heel to the toe and they are joined to each other at the opening of the top line. After knitting, one of the knitted fabrics is inserted into the other from the opening of the top line into the footwear comprising the double-layered knitted fabric. The footwear is manufactured seamlessly by means of a flat knitting machine, includes a small number of components, and is lightweight and thin.

Patent Literature 2 (JP2015-14058A) discloses to join the two side portions of the sole seamlessly to the side portions of the heel holding portion when a footwear is knitted on a flat knitting machine. Furthermore, Patent Literature 3 (WO 2008/143172) discloses knitting three-dimensional knitted fabric having a bottom.

There are various footwear designs. Depending on the application, thin and lightweight footwears, thick footwears with enhanced strength, and footwears with cushioning characteristics and foot supporting properties are required. Furthermore, footwears may be provided with a tongue, protrusion portions on both sides of a tongue, and a heel pocket, for example. In Patent Literature 1, a footwear of specific design can be knitted, but the method is not appropriate for knitting various footwear designs. Currently, there are knitting methods for respective basic designs such as single layered footwear or double layered footwear, and there are also knitting methods appropriate for respective local designs as to whether a tongue is provided. Such knitting methods need to be combined to a knitting method appropriate for a desired design. This work requires skill and time and is inefficient.

CITATION LIST

Patent Literatures

Patent Literature 1: WO2014/203585
Patent Literature 2: JP2015-14058A
Patent Literature 3: WO2008/143172

SUMMARY OF THE INVENTION

Problems to be Solved by the Invention

It is an object of the present invention to provide a method of manufacturing a footwear and the footwear applicable to various designs.

Means for Solving Problem

A method of manufacturing the footwear according to the present invention, manufacturing a knitted fabric constituting a footwear from a toe to a heel, by means of a flat knitting machine having a front needle bed and a back needle bed, the method comprises the steps of and carried out in the following order:

a: knitting a first bag-like knitted fabric comprising a knitted fabric whose lower end is closed to form the toe and whose upper end is open, and a second bag-like knitted fabric whose lower end is closed to form the toe and whose upper end is open or a C-like knitted fabric that is open on a side opposite to the first bag-like knitted fabric in a longitudinal direction of the needle beds, from the lower ends of the knitted fabrics to the upper ends, such that a part of stitches of the first bag-like knitted fabric are held on the front needle bed and the other stitches of the first bag-like knitted fabric are held on the back needle bed, and a part of stitches of the second bag-like knitted fabric or the C-like knitted fabric are held on the front needle bed, and the other stitches of the second bag-like knitted fabric or the C-like knitted fabric are held on the back needle bed;

b: forming double stitches between a part of stitches at the upper end of the first bag-like knitted fabric and a part of stitches at the upper end of the second bag-like knitted fabric or the C-like knitted fabric and binding off to take off the stitches from the needle beds;

c: circulating on the needle beds remaining stitches at the upper end of the first bag-like knitted fabric not bound off and remaining stitches at the upper end of the second bag-like knitted fabric or the C-like knitted fabric not bound off, so that rows of the stitches are rotated on the needle beds, and arranging the knitted fabrics so that the remaining stitches at the upper end of the first bag-like knitted fabric (4) are held on either one of the front needle bed and the back needle bed, and the remaining stitches at the upper end of the second bag-like knitted fabric or the C-like knitted fabric are held on the other one of the front needle bed and the back needle bed; and d: knitting knitted fabrics following the remaining stitches at the upper end of the first bag-like knitted fabric and the remaining stitches at the upper end of the second bag-like knitted fabric or the C-like knitted fabric toward the heel of the footwear.

Note that, in the step c, the feature that the remaining stitches at the upper end of the first bag-like knitted fabric are held on either one of the front needle bed and the back needle bed means that the main portion or majority of the remaining stitches are held on one needle bed. In the step c, the feature that the remaining stitches at the upper end of the second bag-like knitted fabric or the C-like knitted fabric are held on the other one of the front needle bed and the back needle bed means that the main portion or majority of the remaining stitches are held on the other needle bed.

A footwear made of a knitted fabric according to the present invention comprises:

a first knitted fabric comprising two bag-like knitted fabrics, or one bag-like knitted fabric and one C-like knitted fabric, each of which extends from a toe to an opening of a top line, and whose course direction crosses a direction connecting the toe to a heel and whose wale direction conforms to the direction connecting the toe to the heel, the two knitted fabrics overlapping each other so that one of the knitted fabrics is accommodated in the other one, and the first knitted fabric is closed on the toe side and open in the opening of the top line, wherein stitches in end portions opposite to the toe of the two bag-like knitted fabrics of the first knitted fabric, or the one bag-like knitted fabric and the one C-like knitted fabric of the first knitted fabric are connected to each other at a peripheral edge of the opening of the top line to form a joining portion, wherein a second knitted fabric that is continuous in a wale direction with the remaining stitches in the end portions opposite to the toe of the first knitted fabric forms a sole and side portions standing upright from the sole and extends to a heel holding portion, and wherein the side portions, the joining portion, and the heel holding portion surround the opening of the top line.

According to the present invention, footwears of various designs are obtained. The portion from the toe to the opening of the top line can be designed depending on the existence of absence of a tongue is provided, on the shape of a tongue, and the like. The portion from the opening of the top line to the heel can be designed in various ways, for example, by providing or not providing projections on both sides of the tongue and the shape of the projections, and by changing knitting between the sole and both side portions thereof. Furthermore, in the present invention, it is possible to manufacture the footwear seamlessly except for a supplementary part, such as joining the projections 22, 23 in FIGS. 4, 5. Note that a sole refers to a flat portion of footwear that supports the bottom of a foot. The footwear of the present invention can be used as, for example, a shoe upper, and can directly serve as footwear if no sole cover is needed.

Preferably, in the step d, a knitted fabric including a sole of the footwear and side portions on two sides of the sole is knitted as a double-layered tubular knitted fabric in which a first layer knitted fabric and a second layer knitted fabric face each other, and both the first layer knitted fabric and the second layer knitted fabric are knitted such that stitches of the side portions are arranged on the needle beds on the respective sides of stitches of the sole of the footwear.

Preferably, the sole and the side portions of the second knitted fabric are both double-layered. Since the sole and the side portions are double-layered, the strength is enhanced. Furthermore, the sole and the side portions are knitted to be double layered but are not limited to simple double-layered knitted fabrics. For example, if the front and back knitted fabrics are tucked with knitting yarn that is hard to bend, it will be possible to form a space between the double-layered knitted fabrics due to the tucked knitting yarn that is hard to bend. Furthermore, if the front and back knitted fabrics are connected to each other with a rib structure, a thick knitted fabric can be obtained.

Preferably, after the step d, the following step is carried out:

knitting a heel holding portion for holding the heel in a three-dimensional shape, following the sole of the sole and the side portions on both sides of the sole of the footwear;

and forming double stitches between stitches at heel-side end portions of the side portions of the sole and the side portions on both sides of the sole of the footwear and stitches of sides of the heel holding portion to join the side portions to the heel holding portion.

With this measure, the resultant footwear has the features that the heel holding portion is continuous with the sole in the wale direction, and heel-side end portions of the side portions are joined seamlessly to side portions of a knitted fabric of the heel holding portion.

More preferably, in the steps a, d, and e, the knitting is performed with a yarn containing thermally fusible yarn, and the following steps are carried out:

f: after the step e, taking off the knitted fabric constituting the footwear from the flat knitting machine, and then making the first bag-like knitted fabric and one of the second bag-like knitted fabric and the C-like knitted fabric outside of the flat knitting machine into a double-layered knitted fabric; and g: after the step f, performing thermal treatment on the knitted fabric constituting the footwear to fuse the thermally fusible yarn. With this measure, the knitted fabrics from the top line to the toe are simply made into a double-layered structure, the shape of the footwear is made stable by thermal-treatment and strengthened.

Particularly preferably, the joining portion protrudes into the opening of the top line. Since the joining portion serves as a tongue or the like, and the joining portion has a long circumferential length due to the protrusion, it becomes easier to move the stitches in the knitting process (step c: in the manufacturing method).

DETAILED DESCRIPTION OF THE PREFERRED EMBODIMENT

Hereinafter, a preferred embodiment for implementing the present invention will be described.

DESCRIPTION OF EMBODIMENT

Figure 1:
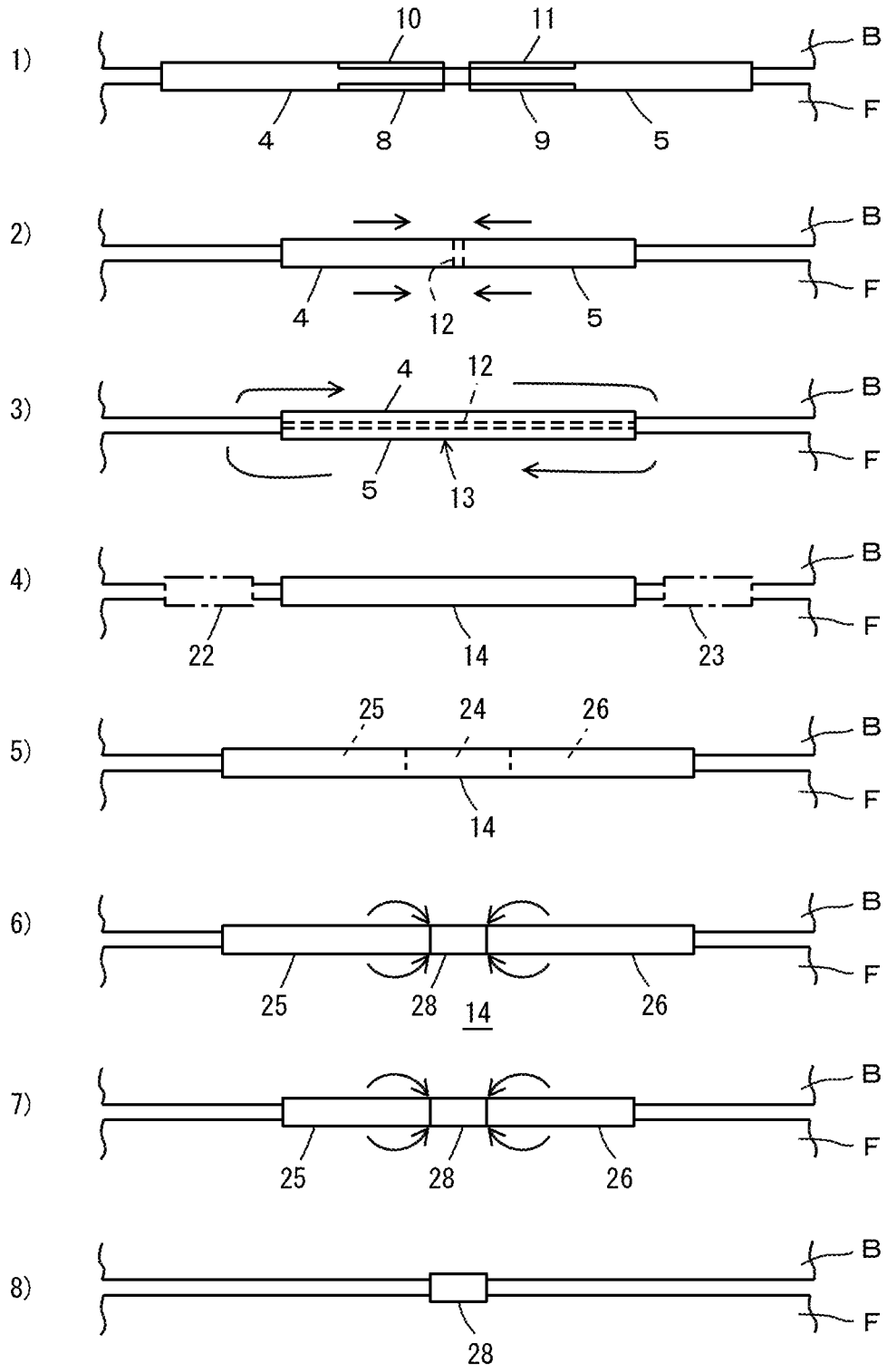
FIG. 1 illustrates a footwear knitting process according to an embodiment.

FIGS. 1 to 9 show an embodiment. FIG. 1 shows knitting of footwear, and the footwear is knitted by means of a flat knitting machine provided with a front needle bed F and a back needle bed B. When the flat knitting machine is provided with two front needle beds and two back needle beds, the pair of front needle beds are collectively referred to as the front needle bed F, and the pair of back needle beds are collectively referred to as the back needle bed B. Knitting yarns used in the knitting preferably contain a thermally fusible yarn (a yarn that may be thermally fused with an adjacent yarn). In 1) in FIG. 1, a pair of bag-like knitted fabrics 4, 5 are knitted; about half of the stitches of each of the bag-like knitted fabrics 4, 5 are held on the front needle bed F, and the remaining stitches are held on the back needle bed B. Note that, instead of the bag-like knitted fabric 5, a C-like knitted fabric 7 including a semicircular end portion 6 may be knitted, as shown by a dash-dotted chain line in FIG. 2. In this case, the C-like knitted fabric 7 is open at a position opposite to the knitted fabric 4 in the longitudinal direction of the needle beds. The bag-like knitted fabrics 4, 5 or the bag-like knitted fabric 4 and the C-like knitted fabric 7 are collectively referred to as a first knitted fabric, and the knitted fabric extending therefrom to a heel holding portion is referred to as a second knitted fabric.

Upon the bag-like knitted fabrics 4, 5 being knitted to the opening of the top line, double stitches are formed between the final end stitches of final end portions 8 and 10 of an instep of the bag-like knitted fabric 4 and the final end stitches of final end portions 9, 11 of an instep of the bag-like knitted fabric 5, and then the bag-like knitted fabrics 4, 5 are joined to each other through bind-off processing. As a result, the final end stitches of the final end portions 8 to 11 are taken off the needle beds F, B, and a joining portion 12 is obtained (FIG. 1, 2)).

When the joining is complete, the stitches of the bag-like knitted fabric 4 face each other on the needle beds F, B, and the stitches of the bag-like knitted fabric 5 face each other on the needle beds F, B. In this state, a type of circulation is performed so that the respective knitted fabrics are separated between one needle bed and the other needle bed. With this operation, the stitches of the bag-like knitted fabric 4 are lined up on one needle bed, for example, the back needle bed B, and the stitches of the bag-like knitted fabric 5 are lined up on the other needle bed, for example, the front needle bed F. The state after the circulation is shown in FIG. 1, 3). The stitches of the bag-like knitted fabrics 4, 5 that are held on the needle beds F, B constitute a single ring-like stitch row 13. Note that some of the stitches of the bag-like knitted fabric 4 may also be held on a different needle bed such as the front needle bed F. Also, some of the stitches of the bag-like knitted fabric 5 may also be held on a different needle bed such as the back needle bed B.

Figure 3:
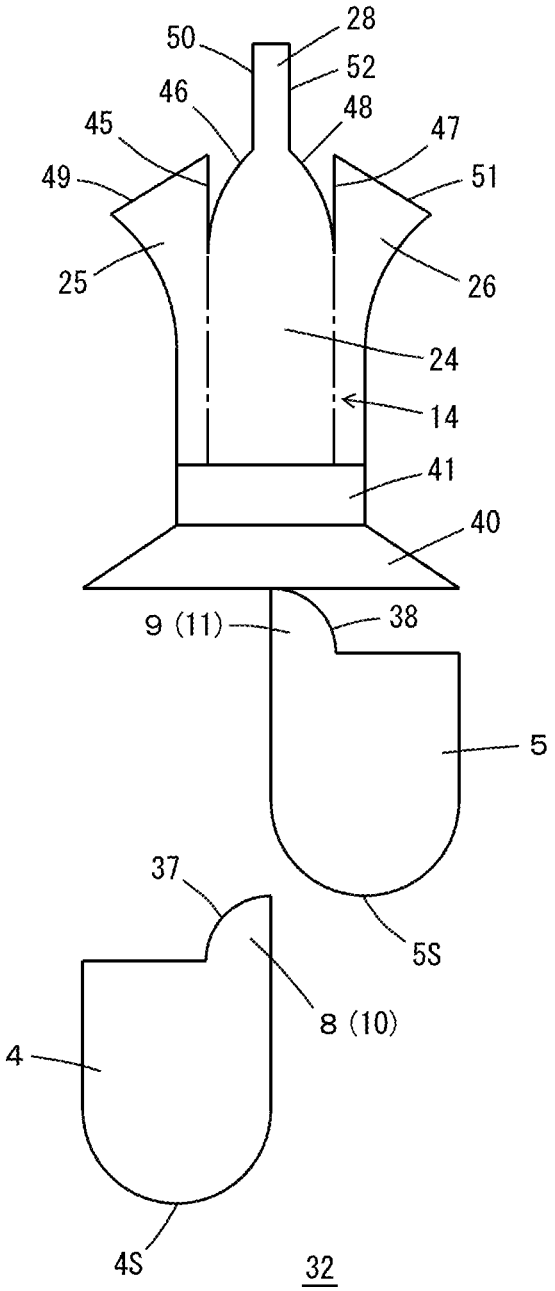
FIG. 3 schematically illustrates knitting of footwear without projections on both sides of a tongue according to the embodiment.

As shown in FIG. 1, 3), when the rotation is performed from the state of 2), the joining portion 12 is stretched so as to have the same length as the knitting width of the stitch row 13 that remains on the needle beds F, B. For example, joining lines 37 and 38 are expanded toward the top line as shown in later-described FIGS. 3, 4. They have an increased circumferential length due to being expanded and thus can withstand being stretched. Note that, if the joining portion 12 originally has a long length or elastic knitting yarn is used, it is preferable that, as shown in later-described FIG. 6, the joining portion 12 is straight. The joining portion 12 may also have a shape of not protruding into the opening of the top line if knitting yarn that can withstand being stretched is used.

Following the stitch row 13, a knitted fabric 14 constituting the sole of the footwear and its two sides is knitted toward the heel (FIG. 1, 4)). The stitch row 13 is held on the front and back needle beds; the stitches of the knitted fabric 5 are held on the front needle bed F, and the stitches of the knitted fabric 4 are held on the back needle bed B. A first layer of the knitted fabric 14 is knitted following the stitches of the stitch row 13 on the front needle bed F, and a second layer of the knitted fabric 14 is knitted following the stitches of the stitch row 13 on the back needle bed B. The knitted fabric 14 is continuous to the bag-like knitted fabrics 4, 5 in the wale direction, is directed from the toe to the heel, and the course direction of the knitted fabric 14 crosses the longitudinal direction of the footwear. Furthermore, the central portion of the knitted fabric 14 on both of the needle beds F, B serves as the sole of the footwear and both sides thereof serve as the side portions of the footwear standing upright on both sides of the sole. Note however that the knitted fabric 14 may include a C-like knitted fabric 20 that has a single-layered sole and double layered side portions. For example, if a sole cover is bonded after the knitting, a shoe that appears the same as a double-layered bag-like knitted fabric and is more lightweight is realized. Alternatively, the outer and inner layers of the double-layered knitted fabric 14 may be joined to each other by tuck stitches, a rib structure, or the like.

To form shoe lace holes on both sides of the tongue of the footwear or the like, projections 22, 23 made of a double-layered knitted fabric may be knitted on the respective left and right sides of the knitted fabric 14, as shown by chain lines in FIG. 1, 4). After the projections 22, 23 have been knitted, the stitches of the left and right end portions of the knitted fabric 14 and the stitches of the projections 22, 23 that are located on the knitted fabric 14 side are joined to each other. Note that the projections 22, 23 may also be a single-layered knitted fabric, instead of a bag-like knitted fabric.

By knitting the knitted fabric 14 toward the heel, a sole 24 and side portions 25 and 26 of the knitted fabric of the footwear are knitted (FIG. 1, 5)). Then, only a heel holding portion 28 is knitted from the central position of a final end portion of the knitted fabric 14. In parallel to the knitting of the heel holding portion 28, the stitches of heel-side final end portions of both side portions 25 and 26 and the stitches of the side end portions of the heel holding portion 28 are joined to each other by forming double stitches therebetween (FIG. 1, 6)). By repeating the same knitting, the width of both side portions 25 and 26 that are held on the needle beds is gradually reduced (FIG. 1, 7)). When the knitting of the heel holding portion 28 is complete, only the heel holding portion 28 is held on the needle beds (FIG. 1, 8)). As a result of the stitches of the final end portions of the heel holding portion 28 being subjected to bind-off processing, the knitting of the footwear is complete.

The footwear is taken off the flat knitting machine, and one of the bag-like knitted fabrics 4, 5 is inserted into and laid on the other one, so that a double-layered knitted fabric including inner and outer layers is realized. Then, the projections 22, 23 are fixed to an instep 30 through sewing, bonding, or the like. Also, the thermally fusible yarn is fused through a thermal treatment to bond the two layers of the double-layered knitted fabric to each other. Thermal treatment and sewing may be performed in any order.

Figure 2:
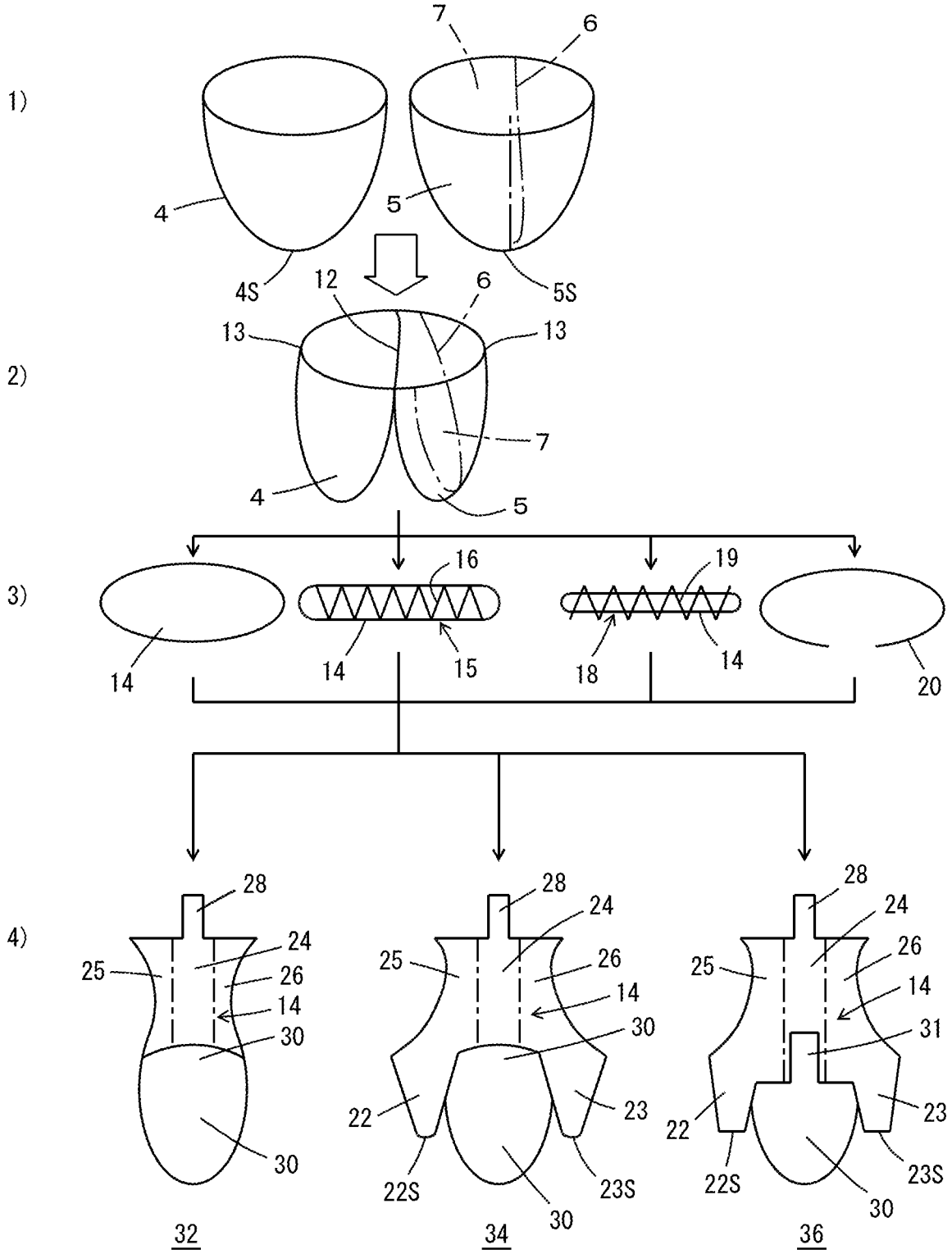
FIG. 2 schematically illustrates the shapes of a knitted fabric until knitting is complete according to the embodiment.

FIG. 2 shows the footwear manufactured by the knitting in accordance with FIG. 1. In 1) in FIG. 2, the bag-like knitted fabrics 4, 5 are knitted and serve as the portion of the footwear that extends from the toe to the opening of the top line. The bag-like knitted fabrics 4, 5 are respectively knitted starting from knitting start portions 4S and 5S, by the method in accordance with Patent Literature 3 (WO2008/143172), for example. The bag-like knitted fabrics 4, 5 are bag-like knitted fabrics that have a closed lower end for the toe, and an open upper end. The state after the knitted fabrics 4, 5 have been joined to each other is shown in FIG. 2, 2). Note that one of the bag-like knitted fabrics 4, 5, for example, the bag-like knitted fabric 5 may be replaced by the C-like knitted fabric 7 having the semicircular end portion 6 as shown by the dash-dotted line in 2), and the C-like opening is located opposite to the bag-like knitted fabric 4 in the longitudinal direction of the needle beds.

Examples of variations of the knitted fabric 14 are shown in FIG. 2, 3). For example, as a knitted fabric 15 of the second example from the left, a knitted fabric that is thick and has superior cushioning, that is, a so-called spacer fabric, is realized by joining the outer and inner layers of the knitted fabric 14 to each other with tuck stitches comprising yarn 16 such as PP fibers (polypropylene fibers) that are hard to bend. Also, as a knitted fabric 18 of the third example from the left, a thick knitted fabric is realized by joining the outer and inner layers of the knitted fabric 14 to each other with a rib structure 19. Alternatively, as a C-like knitted fabric 20 of the fourth example from the left, a light-weight knitted fabric is realized by, instead of making the entire footwear double-layered, making the sole portion of the footwear single-layered and both side portions thereof double-layered. Even when the C-like knitted fabric 7 is knitted on the toe side, a double-layered knitted fabric 14 can be knitted by increasing the number of stitches in the missing portion with split knitting (see EP890667B1 and EP2436811A2) or the like.

In 4) in FIG. 2, only the heel holding portion 28 is knitted from the central position of the final end portion of the knitted fabric 14, and in parallel to the knitting of the heel holding portion 28, the stitches of the heel-side final end portions of both side portions 25 and 26 and the stitches of the side end portions of the heel holding portion 28 are joined to each other by forming double stitches therebetween. Furthermore, the reference numeral 30 denotes the instep of the footwear comprising the bag-like knitted fabrics 4, 5 or the bag-like knitted fabric 4 and the C-like knitted fabric 7. Various types of footwear can be knitted by changing whether or not the projections 22, 23 are provided, the shape of a tongue, a knitting structure (structure pattern) of the instep 30 of the knitted fabric 14, whether or not an accessory such as a pocket is provided on the instep 30 and the knitted fabric 14, and the like. For example, a piece of footwear 32 is of a slip-on type without the projections 22, 23. A piece of footwear 34 is of a so-called casual type with the projections 22, 23. A piece of footwear 36 is of a so-called sports type with a tongue 31 that protrudes into the opening of the top line.

Figure 4:
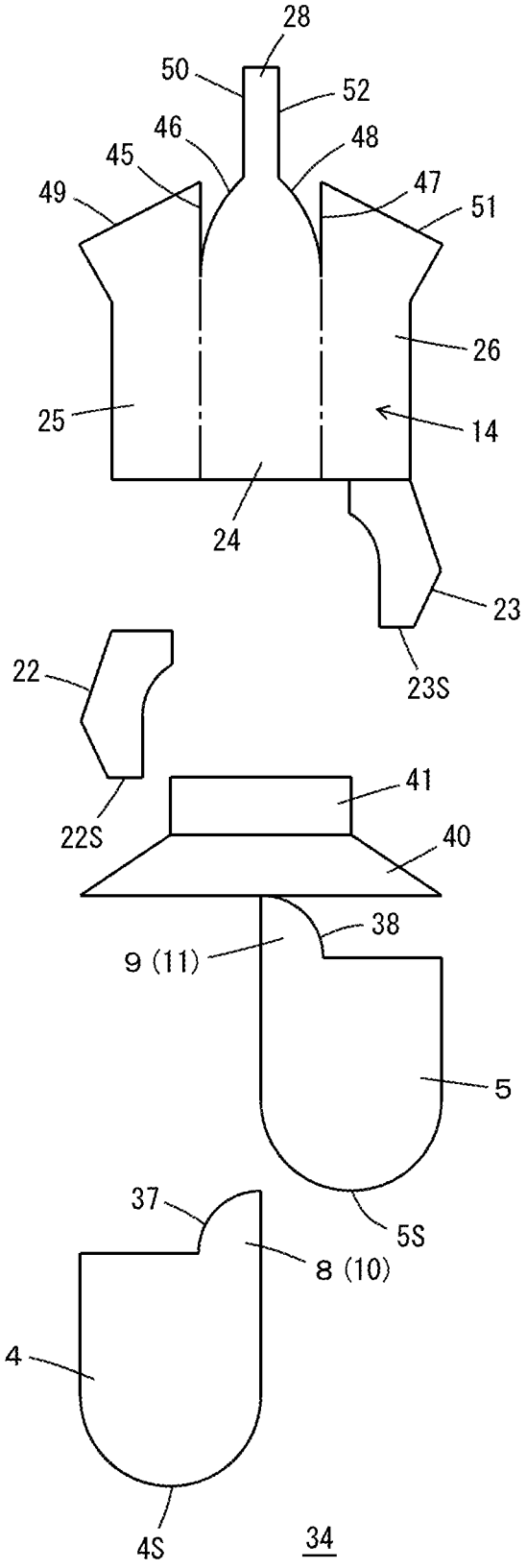
FIG. 4 schematically illustrates knitting of footwear provided with projections on both sides of a tongue according to the embodiment.
Figure 5:
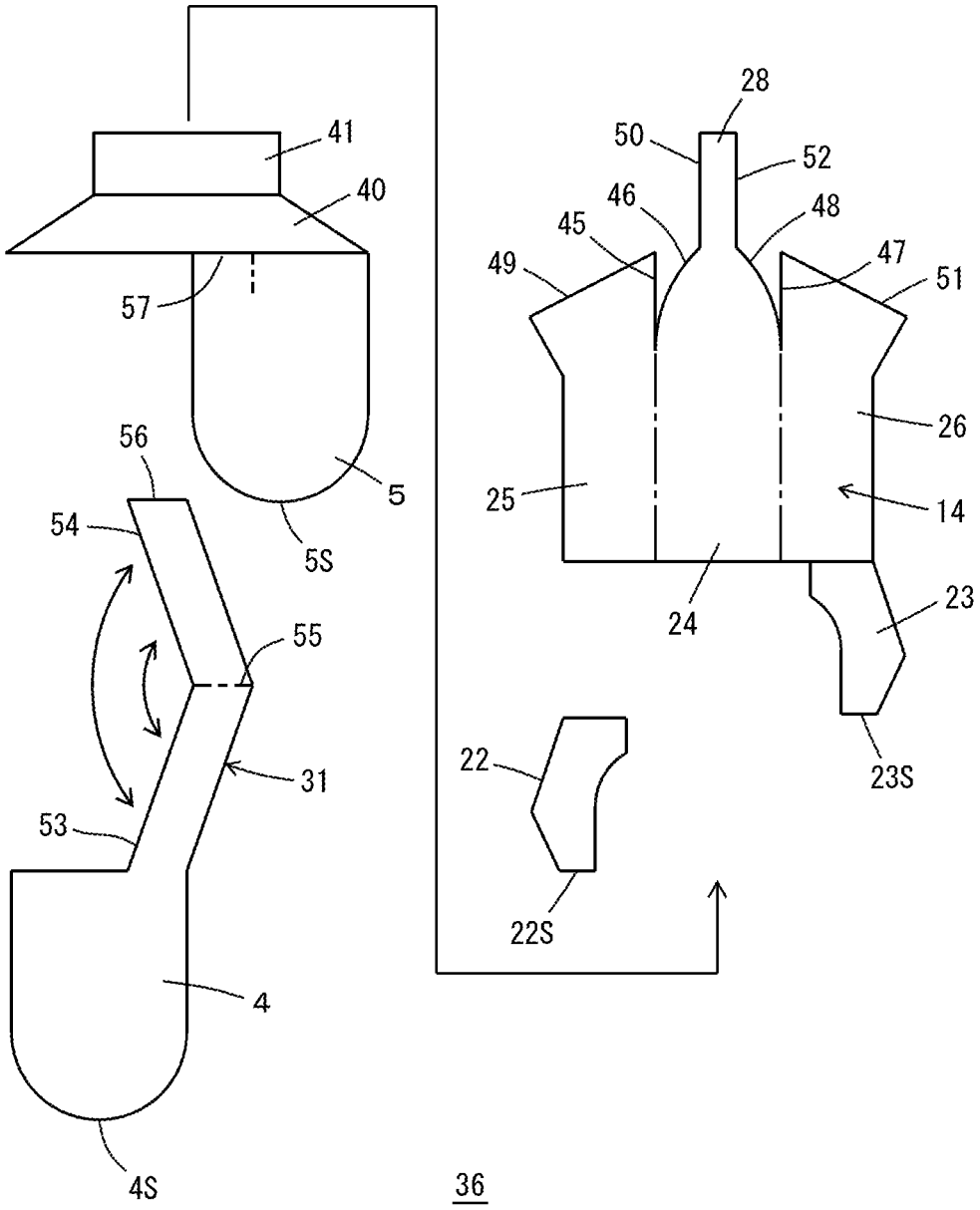
FIG. 5 schematically illustrates knitting of footwear with a long tongue according to the embodiment.
Figure 6:
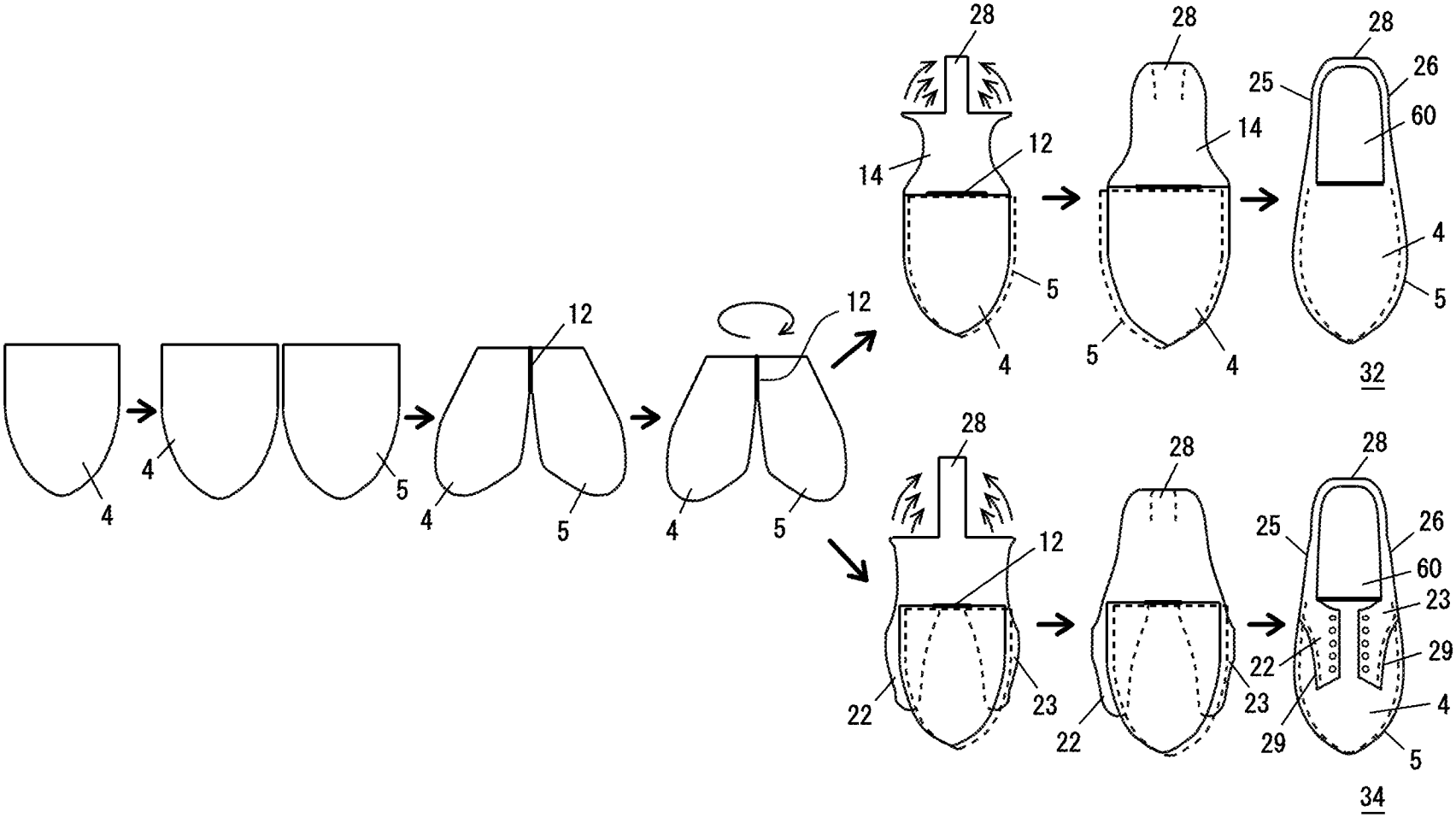
FIG. 6 illustrates an outline of the footwear manufacturing process according to the embodiment.
Figure 7:
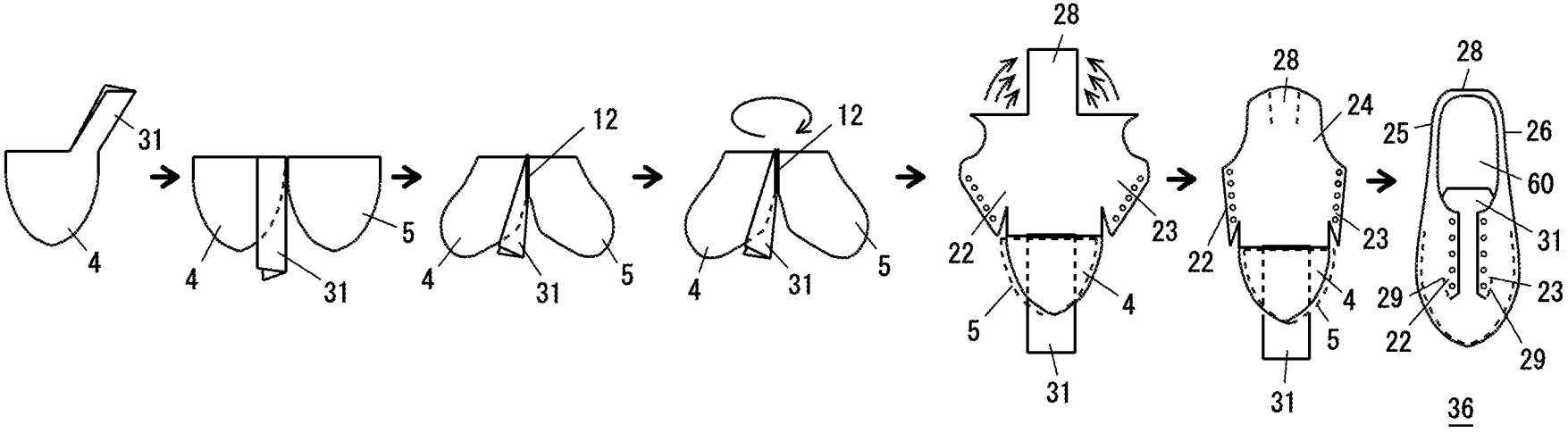
FIG. 7 illustrates an outline of a process for manufacturing footwear with a long tongue according to the embodiment.

FIGS. 3 to 5 show the pieces of footwear 32, 34, and 36. The parts 4, 5 in FIGS. 3 to 5 are each made of a bag-like knitted fabric, and the parts 8 and 10 belonging to the bag-like knitted fabric 4 have the same shape, and the parts 9, 11 belonging to the bag-like knitted fabric 5 also have the same shape. Furthermore, the parts 14 to 28 are each made of a tubular knitted fabric or a double-layered knitted fabric. Parts such as the bag-like parts have the outer knitted fabric and the inner knitted fabric in the same shape, and half of the stitches of each knitted fabric are held on the respective front and back needle beds. Note that, in the pieces of footwear 32, 34, and 36, the bag-like knitted fabrics 4, 5 are knitted starting from the knitting start portions 4S and 5S, in which, instead of the bag-like knitted fabric 5, the C-like knitted fabric 7 may be knitted.

In the case of the pieces of footwear 32 and 34, the final end portions 8 to 11 protruding relatively slightly from the bag-like knitted fabrics 4, 5 are knitted. In contrast, in the case of the piece of footwear 36, the tongue 31 protruding relatively largely from the bag-like knitted fabric 4 is knitted. Here, the tongue 31 is knitted in the following manner:

On the front and back needle beds, knitting is performed up to an intermediate fold back 55 while forming yarn overs for connection and moving toward the bag-like knitted fabric 5; and Knitting is performed from the fold back 55 while moving to return toward the bag-like knitted fabric 4, and the stitches of a joining line 53 and the stitches of a joining line 54 are joined to each other by forming double stitches therebetween. As a result, a double-layered tongue 31 is obtained.

When the knitting of the final end portions 8 to 11, or 31 is complete, joining knitting 40 is performed to join the bag-like knitted fabrics 4, 5 to each other. In the cases of the pieces of footwear 32 and 34, double stitches are formed between the final end stitches of the final end portions 8 and 9 along the joining lines 37 and 38, and the final end stitches are bound off and are taken off the needle beds. Similarly, double stitches are formed between the final end stitches of the final end portions 10 and 11, and the final end stitches are bound off and are taken off the needle beds. In the case of the piece of footwear 36, double stitches are formed between the stitches of a joining line 56 of the tongue 31 and the stitches of a joining line 57 of the bag-like knitted fabric 5 or the like, and the stitches are bound off and are taken off the needle beds. After the completion of the joining knitting 40, the knitted fabric is in the state shown in FIG. 1, 2).

Then, circulation 41 is performed to rotate the bag-like knitted fabrics 4, 5 or the like on the needle beds by about 90°, and the side portions are arranged on both sides of the sole of the footwear on the needle beds. After the completion of the circulation 41, the knitted fabric is in the state shown in FIG. 1, 3). If the projections 22, 23 are to be provided, after the circulation 41 for example, projections 22, 23 each made of, for example, a double layered knitted fabric are knitted starting from the knitting start portions 22S and 23S. Shoe lace holes through which, for example, a shoe lace is inserted are formed in the projections 22, 23.

Subsequently, the double-layered knitted fabric 14 is knitted toward the heel, in a state in which the sole 24 is arranged in the center in the knitting width, and the side portions 25 and 26 are arranged on both sides thereof. The reference numerals 45 to 48 denote borderlines of the parts, and actually there is no gap between the borderlines 45 and 46, and similarly there is also no gap between the borderlines 47 and 48. The heel holding portion 28 is knitted from the central portion in the knitting width of the sole 24 (the central portion in the course direction). At the same time as the knitting of the heel holding portion 28, a side end portion 50 of the heel holding portion 28 is joined to a final end portion 49 of the side portion 25, and a side end portion 52 of the heel holding portion 28 is joined to a final end portion 51 of the side portion 26.

The knitting ends therewith, and only the heel holding portion 28 is held on the needle beds (FIG. 1, 8)), and then, the final end of the heel holding portion 28 is subjected to bind-off processing, and is taken off the needle beds. Thereafter, the bag-like knitted fabric 5 or the C-like knitted fabric 7 is inserted into the bag-like knitted fabric 4 so that they overlap each other, and the pieces of footwear 32, 34, and 36 are subjected to thermal treatment. Furthermore, the projections 22, 23 are sewed to the bag-like knitted fabrics 4, 5 or the like at the seam line 29, if necessary. The methods for manufacturing the pieces of footwear 32, 34, and 36 are again shown in FIGS. 6 and 7. The region enclosed by the final end portions 8 to 11, and 31, and the region enclosed by the side portions 25 and 26 and the heel holding portion 28 serve as the opening 60 of the top line.

Figure 8:
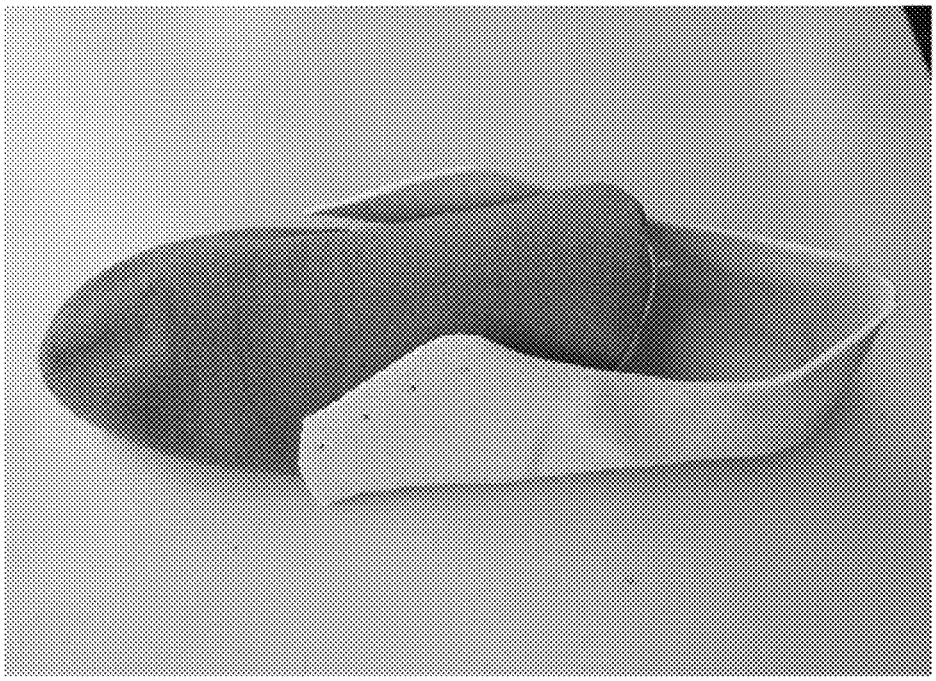
FIG. 8 is a photograph of knitted casual footwear as viewed from the obverse side.
Figure 9:
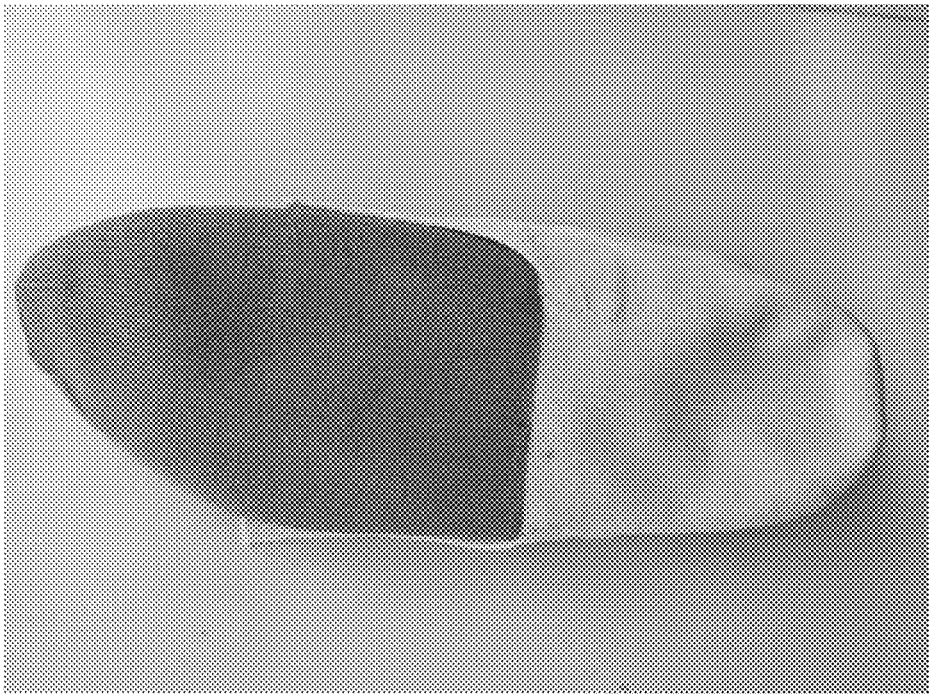
FIG. 9 is a photograph of the knitted casual footwear as viewed from the sole side.

FIGS. 8 and 9 show the knitted and thermally treated casual footwear 34, in which the left side of the drawings shows the toe and the right side shows the heel. FIG. 8 shows the state as viewed from above, and FIG. 9 shows the state as viewed from below.

The embodiment is also applicable to variations other than those already described. For example, it is possible to provide a pocket in which an article can be inserted in the vicinity of the heel. Furthermore, by knitting a thick knitted fabric, it is possible to reinforce a specific position. Moreover, stretchability, air permeability, and the like of the knitted fabric can be varied depending on the position, or a structure pattern or the like may also be added. To realize such variations, it is sufficient to change the knitting structure at the corresponding position.

DESCRIPTION OF REFERENCE NUMERALS

F, B Needle bed
4, 5 Bag-like knitted fabric
4S, 5S Knitting start portion
6 End portion
7 C-like knitted fabric
8 to 11 Final end portion
12 Joining portion
13 Ring-like stitch row
14 Knitted fabric of the sole and its two sides
15, 18 Knitted fabric
16 Joining yarn
19 Rib structure
20 C-like knitted fabric
22, 23 Projection
22S, 23S Knitting start portion
24 Sole
25, 26 Side portion
28 Heel holding portion
29 Seam line
30 Instep
31 Tongue
32, 34, 36 Footwear
37, 38 Joining line
40 Joining knitting (knit for joining)
41 Circulation
45 to 48 Borderline
49, 51 Final end portion
50, 52 Side end portion
53, 54 Joining line
55 Fold back
56, 57 Joining line
60 Opening of the top line

The invention claimed is:

1. A method of manufacturing a footwear, manufacturing a knitted fabric constituting the footwear from a toe to a heel, by means of a flat knitting machine having a front needle bed and a back needle bed, the method comprising the steps of and carried out in the following order:

a: knitting a first bag-shaped knitted fabric comprising a knitted fabric whose lower end is closed to form the toe and whose upper end is open, and a second bag-shaped knitted fabric whose lower end is closed to form the toe and whose upper end is open or a C-shaped knitted fabric that is open on a side opposite to the first bag-shaped knitted fabric in a longitudinal direction of the needle beds, from the lower ends of the knitted fabrics to the upper ends, such that a part of stitches of the first bag-shaped knitted fabric are held on the front needle bed and the other stitches of the first bag-shaped knitted fabric are held on the back needle bed, and a part of stitches of the second bag-shaped knitted fabric or the C-shaped knitted fabric are held on the front needle bed, and the other stitches of the second bag-shaped knitted fabric or the C-shaped knitted fabric are held on the back needle bed;

b: forming double stitches between a part of stitches at the upper end of the first bag-shaped knitted fabric and a part of stitches at the upper end of the second bag-shaped knitted fabric or the C-shaped knitted fabric and binding off to take off the stitches from the needle beds;

c: circulating on the needle beds remaining stitches at the upper end of the first bag-shaped knitted fabric not bound off and remaining stitches at the upper end of the second bag-shaped knitted fabric or the C-shaped knitted fabric not bound off, so that rows of the stitches are rotated on the needle beds, and arranging the knitted fabrics so that the remaining stitches at the upper end of the first bag-shaped knitted fabric are held on either one of the front needle bed and the back needle bed, and the remaining stitches at the upper end of the second bag-shaped knitted fabric or the C-shaped knitted fabric are held on the other one of the front needle bed and the back needle bed; and d: knitting knitted fabrics following the remaining stitches at the upper end of the first bag-shaped knitted fabric and the remaining stitches at the upper end of the second bag-shaped knitted fabric or the C-shaped knitted fabric toward the heel of the footwear.

2. The method of manufacturing a footwear according to claim 1, characterized in that, in the step d, a knitted fabric including a sole of the footwear and side portions on two sides of the sole is knitted as a double-layered tubular knitted fabric in which a first layer knitted fabric and a second layer knitted fabric face each other, and both the first layer knitted fabric and the second layer knitted fabric are knitted such that stitches of the side portions are arranged on the needle beds on the respective sides of stitches of the sole of the footwear.

3. The method of manufacturing a footwear according to claim 1, further comprising the step for:

e: after the step d, a step for knitting a heel holding portion for holding the heel in a three-dimensional shape, following the sole of the sole and the side portions on both sides of the sole of the footwear, and forming double stitches between stitches at heel-side end portions of the side portions of the sole and the side portions on both sides of the sole of the footwear and stitches of sides of the heel holding portion to join the side portions to the heel holding portion.

4. The method of manufacturing a footwear according to claim 3, characterized in that, in the steps a, d, and e, the knitting is performed with a yarn containing thermally fusible yarn, and the method further comprises the steps for:

f: after the step e, taking off the knitted fabric constituting the footwear from the flat knitting machine, and then making the first bag-shaped knitted fabric and one of the second bag-shaped knitted fabric and the C-shaped knitted fabric outside of the flat knitting machine into a double-layered knitted fabric; and g: after the step f, performing thermal treatment on the knitted fabric constituting the footwear to fuse the thermally fusible yarn.

5. A footwear made of a knitted fabric, comprising:

a first knitted fabric comprising two bag-shaped knitted fabrics, or one bag-shaped knitted fabric and one C-shaped knitted fabric, each of which extends from a toe to an opening of a top line, and whose course direction crosses a direction connecting the toe to a heel and whose wale direction conforms to the direction connecting the toe to the heel, the two knitted fabrics overlapping each other so that one of the knitted fabrics is accommodated in the other one, and the first knitted fabric is closed on the toe side and open in the opening of the top line, wherein stitches in end portions opposite to the toe of the two bag-shaped knitted fabrics of the first knitted fabric, or the one bag-shaped knitted fabric and the one C-shaped knitted fabric of the first knitted fabric are connected to each other at a peripheral edge of the opening of the top line to form a joining portion, wherein a second knitted fabric that is continuous in a wale direction with the remaining stitches in the end portions opposite to the toe of the first knitted fabric forms a sole and side portions standing upright from the sole and extends to a heel holding portion, and wherein the side portions, the joining portion, and the heel holding portion surround the opening of the top line.

6. The footwear according to claim 5, characterized in that the sole and the side portions of the second knitted fabric are both double-layered.

7. The footwear according to claim 5, characterized in that the heel holding portion is continuous with the sole in the wale, and heel-side end portions of the side portions are joined to sides of the heel holding portion.

8. The footwear according to claim 5, characterized in that the joining portion protrudes into the opening of the top line.

9. The method of manufacturing a footwear according to claim 2, further comprising the step for:

e: after the step d, a step for knitting a heel holding portion for holding the heel in a three-dimensional shape, following the sole of the sole and the side portions on both sides of the sole of the footwear, and forming double stitches between stitches at heel-side end portions of the side portions of the sole and the side portions on both sides of the sole of the footwear and stitches of sides of the heel holding portion to join the side portions to the heel holding portion.

10. The footwear according to claim 6, characterized in that the heel holding portion is continuous with the sole in the wale, and heel-side end portions of the side portions are joined to sides of the heel holding portion.

11. The footwear according to claim 6, characterized in that the joining portion protrudes into the opening of the top line.

12. The footwear according to claim 7, characterized in that the joining portion protrudes into the opening of the top line.

13. The footwear according to claim 10, characterized in that the joining portion protrudes into the opening of the top line.

14. The method of manufacturing a footwear according to claim 9, characterized in that, in the steps a, d, and e, the knitting is performed with a yarn containing thermally fusible yarn, and the method further comprises the steps for:

f: after the step e, taking off the knitted fabric constituting the footwear from the flat knitting machine, and then making the first bag-shaped knitted fabric and one of the second bag-shaped knitted fabric and the C-shaped knitted fabric outside of the flat knitting machine into a double-layered knitted fabric; and g: after the step f, performing thermal treatment on the knitted fabric constituting the footwear to fuse the thermally fusible yarn.

* * * * *